US008888663B2

(12) United States Patent
Ross et al.

(10) Patent No.: US 8,888,663 B2
(45) **Date of Patent: *Nov. 18, 2014**

(54) ADJUSTABLE EXERCISE DEVICES

(71) Applicant: Exemplar Design, LLC, Mason, OH (US)

(72) Inventors: Adam L. Ross, Mason, OH (US); Benjamin P. Boyer, Ridgeley, WV (US)

(73) Assignee: Exemplar Design, LLC, Mason, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/107,177

(22) Filed: Dec. 16, 2013

(65) Prior Publication Data

US 2014/0106944 A1 Apr. 17, 2014

Related U.S. Application Data

(63) Continuation of application No. 13/091,447, filed on Apr. 21, 2011, now Pat. No. 8,608,627.

(60) Provisional application No. 61/326,883, filed on Apr. 22, 2010.

(51) Int. Cl.

| | |
|---|---|
| ***A63B 21/06*** | (2006.01) |
| ***A63B 21/072*** | (2006.01) |
| ***A63B 21/075*** | (2006.01) |

(52) U.S. Cl.

CPC ..... *A63B 21/0724* (2013.01); *A63B 21/072* (2013.01); *A63B 21/075* (2013.01)

USPC ..... 482/93; 482/108

(58) Field of Classification Search

CPC ..... A63B 21/075; A63B 21/06; A63B 21/00061; A63B 21/00065; A63B 21/00069; A63B 21/00058; A63B 21/00; A63B 43/02; A63B 43/00; A63B 23/12; A63B 21/0004; A63B 21/0605; A63B 21/072

USPC ..... 482/19, 107, 98, 109, 50, 908, 22, 44, 482/47, 49, 910, 94, 97; D21/662, 668

See application file for complete search history.

(56) References Cited

U.S. PATENT DOCUMENTS

| | | | | |
|---|---|---|---|---|
| 6,387,022 | B1 * | 5/2002 | Smith | 482/106 |
| 2003/0060346 | A1 * | 3/2003 | Wu | 482/108 |

* cited by examiner

*Primary Examiner* — Loan H Thanh
*Assistant Examiner* — Rae Fischer
(74) *Attorney, Agent, or Firm* — Baker & Hostetler LLP

(57) ABSTRACT

Adjustable-weight exercise devices are disclosed. An example adjustable-weight exercise device may include an exercise device body; a generally cylindrical cavity extending into the exercise device body and comprising at least one engagement feature; and a generally cylindrical weight insert configured to be slidably received the cavity and comprising a corresponding engagement feature. The engagement feature and the corresponding engagement feature may be configured to releasably engage each other to selectively retain the generally cylindrical weight insert within the generally cylindrical cavity.

19 Claims, 13 Drawing Sheets

ADJUSTABLE EXERCISE DEVICES

CROSS REFERENCE TO RELATED APPLICATIONS

This application claims priority to U.S. application Ser. No. 13/091,447, currently pending, which claims the benefit of U.S. Provisional Application No. 61/326,883, filed Apr. 22, 2010, each of which is hereby incorporated by reference.

BACKGROUND

The present disclosure pertains to exercise devices, which may be configured receive one or more weight inserts to change the total weight of the exercise device and, more particularly, to adjustable-weight exercise devices, such as adjustable-weight medicine balls.

The following documents may be generally relevant to the subject matter of the present disclosure and are hereby incorporated by reference into this Background section: U.S. Pat. Nos. 1,316,683; 4,917,381; 6,387,022; 7,238,147; and 7,381,157; and U.S. Patent Application Publication No. 2008/0081744.

SUMMARY

Exercise devices are generally disclosed. Some example embodiments may include methods, apparatus, and/or systems pertaining to adjustable-weight exercise devices, such as adjustable-weight medicine balls.

Some example adjustable-weight exercise devices according to at least some aspects of the present disclosure may include an exercise device body; a cavity extending into the exercise device body and including at least one engagement feature; and a weight insert configured to be slidably received in the cavity, the weight insert including a corresponding engagement feature. The engagement feature and the corresponding engagement feature may be configured to releasably engage each other to selectively retain the weight insert within the cavity.

Some example adjustable-weight medicine ball systems according to at least some aspects of the present disclosure may include a medicine ball body having a generally spherical form and including laterally opposed side handles and a generally cylindrical cavity. The generally cylindrical cavity may include an engagement feature at its bottom. An adjustable-weight medicine ball system may include a first generally cylindrical weight insert configured to be received within the generally cylindrical cavity of the medicine ball body. The first weight insert may include a corresponding engagement feature on its bottom.

Some example methods of operating adjustable-weight medicine balls according to at least some aspects of the present disclosure may include sliding a first weight insert into a cavity of a medicine ball body to engage an upstanding ring proximate a bottom of the cavity with an opening proximate a bottom of the first weight insert. Then, a method of operating an adjustable-weight medicine ball may include rotating the first weight insert with respect to the cavity to engage at least two radially outwardly extending, circumferentially arranged tabs on the upstanding ring with at least two radially inwardly extending tabs on the opening.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings.

In the drawings.

DETAILED DESCRIPTION

Figure 1:
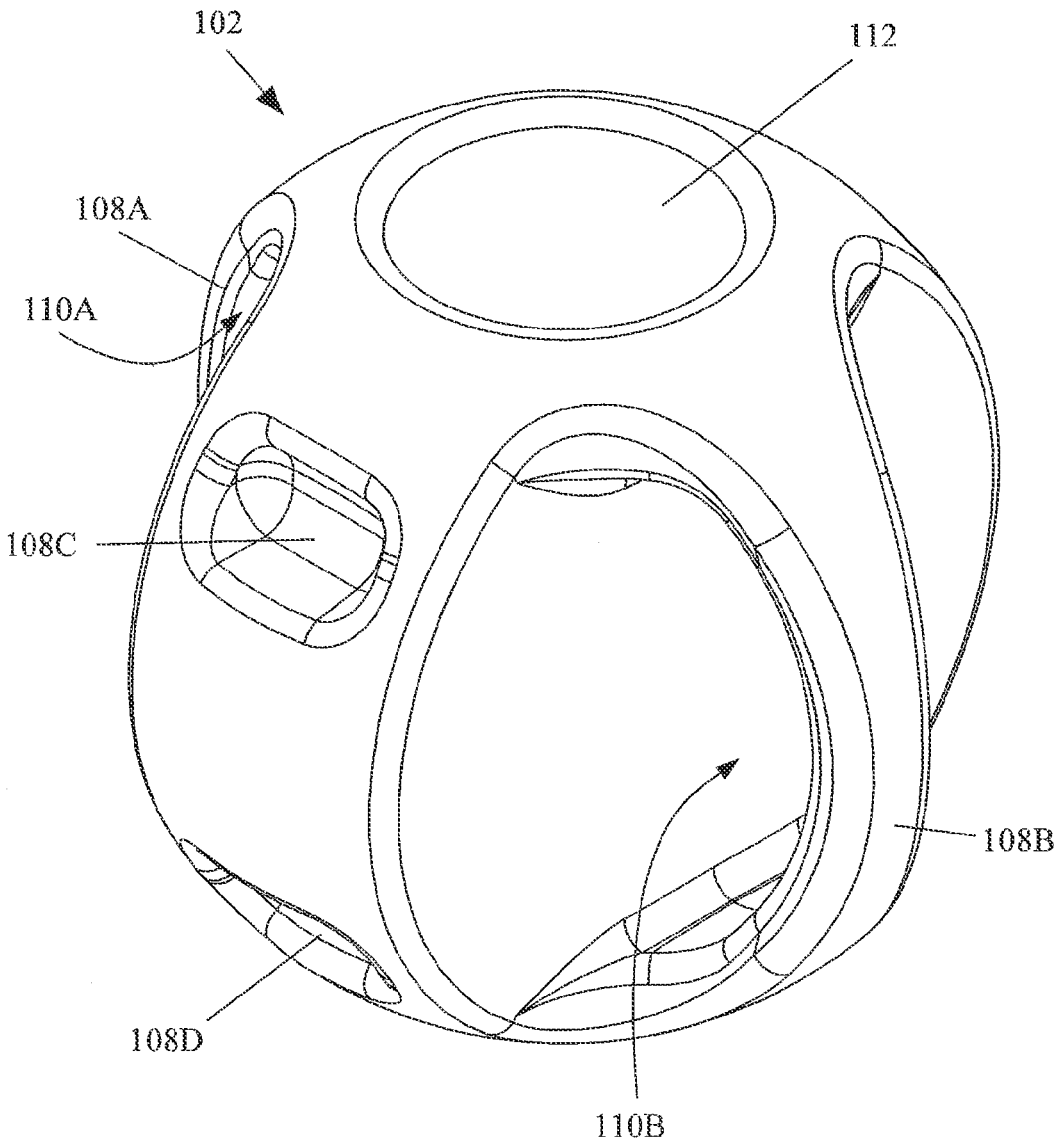
FIG. 1 is a perspective view of an example medicine ball body.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be used, and other changes may be made, without departing from the spirit or scope of the subject matter presented here. It will be readily understood that the aspects of the present disclosure, as generally described herein, and illustrated in the Figures, may be arranged, substituted, combined, and designed in a wide variety of different configurations, all of which are explicitly contemplated and make part of this disclosure.

Methods, systems, devices, and/or apparatus related to athletic training equipment are described. Some example embodiments according to the present disclosure may pertain to adjustable-weight exercise devices, such as adjustable-weight medicine balls. The present disclosure includes, inter alia, exercise devices which may be configured receive one or more weight inserts to change the total weight of the exercise devices. For example, a medicine ball according to the present disclosure may include a substantially hollow cavity configured to receive weighted inserts therein so that a plurality of total weights may be provided by one medicine ball.

The present disclosure contemplates that, in the world of health and fitness, storage space for exercise equipment may be limited. In numerous public facilities as well as home gyms, there may not be enough usable space for all desired weight equipment. Often times, public and home gym owners may not purchase all desired and potentially useful weight equipment because there is not enough storage space available. Also, when more than one piece of the same type of equipment is needed (e.g., medicine balls of various weights), more space may be necessary.

The present disclosure contemplates that, in order to be able to use differently weighted medicine balls, one typically obtains a collection of medicine balls of different weights. For example, when exercising, one may use a ten pound medicine ball for assistance with crunches. However, when performing Russian twists, one may use a fourteen pound medicine ball. In order to accomplish this, an individual typically uses two separate medicine balls, one weighing ten pounds and one weighing fourteen pounds. In public gyms, there are often stacks of differently weighted medicine balls for all users. For home owners, this is typically the same situation.

Some example exercise devices according to the present disclosure may reduce the amount of space occupied by exercise devices by replacing a plurality of differently weighted medicine balls with a lesser number of adjustable-weight medicine balls. For example, two adjustable medicine balls according to the present disclosure may replace a standard set of medicine balls without sacrificing the ability to select from among a large number of total weights. Thus, some example devices according to the present disclosure may contribute to solving the issue of space limitations in the gym.

Figure 2:
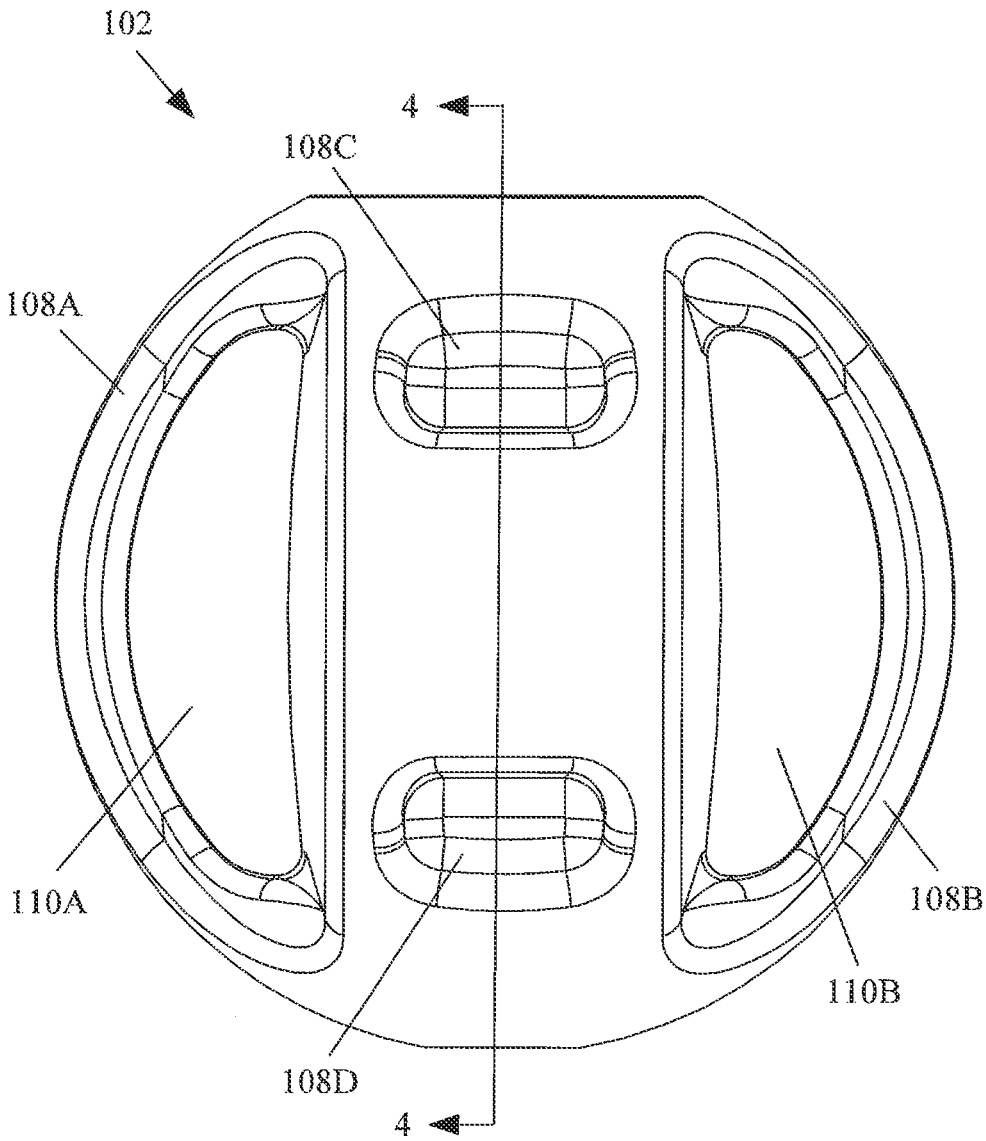
FIG. 2 is a front elevation view of an example medicine ball body.

FIGS. 1 and 2 illustrate an example medicine ball body 102 according to at least some embodiments of the present disclosure. Some example medicine ball bodies 102 according to the present disclosure may be generally spherical in form. Some example medicine ball bodies 102 may include one or more side handles 108A, 108B, which may be configured to be gripped by a user. In some example embodiments, side handles 108A, 108B may be located substantially opposite each other on medicine ball 102. In some example embodiments, side handles 108A, 108B may be integrally formed as part of the generally spherical form of medicine ball 102 and/or may be defined by openings 110A, 110B, which may extend at least partway through medicine ball body 102. Some example medicine balls may be constructed of rubber and/or plastic, for example.

Figure 5:
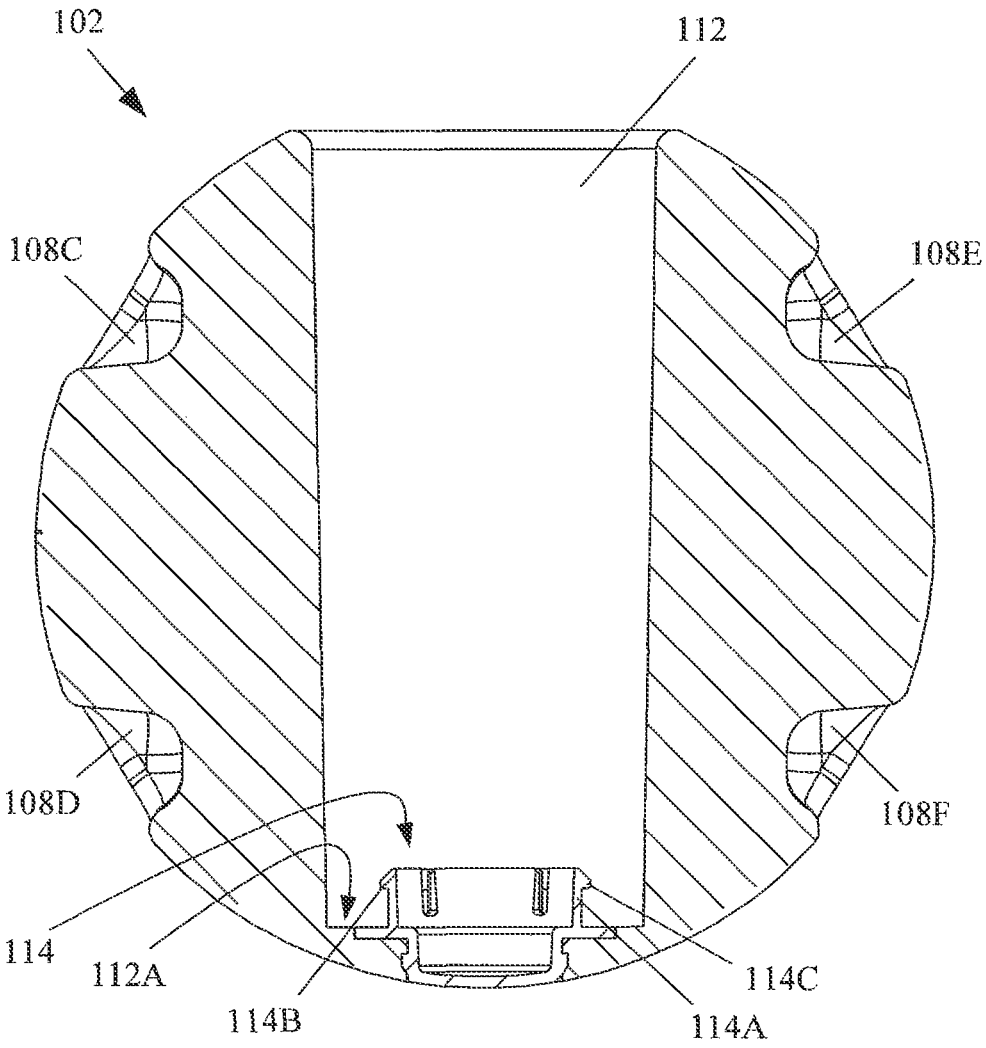
FIG. 5 is an elevation cross-section view of an example medicine ball body.

Some example medicine ball bodies 102 according to the present disclosure may include one or more front handles 108C, 108D and/or rear handles 108E, 108F (see, e.g., FIG. 5). Front handles 108C, 108D and/or rear handles 108E, 108F may comprise depressions into the generally spherical form of medicine ball body 102 and/or may be configured to be gripped by a user's fingers.

Figure 3:
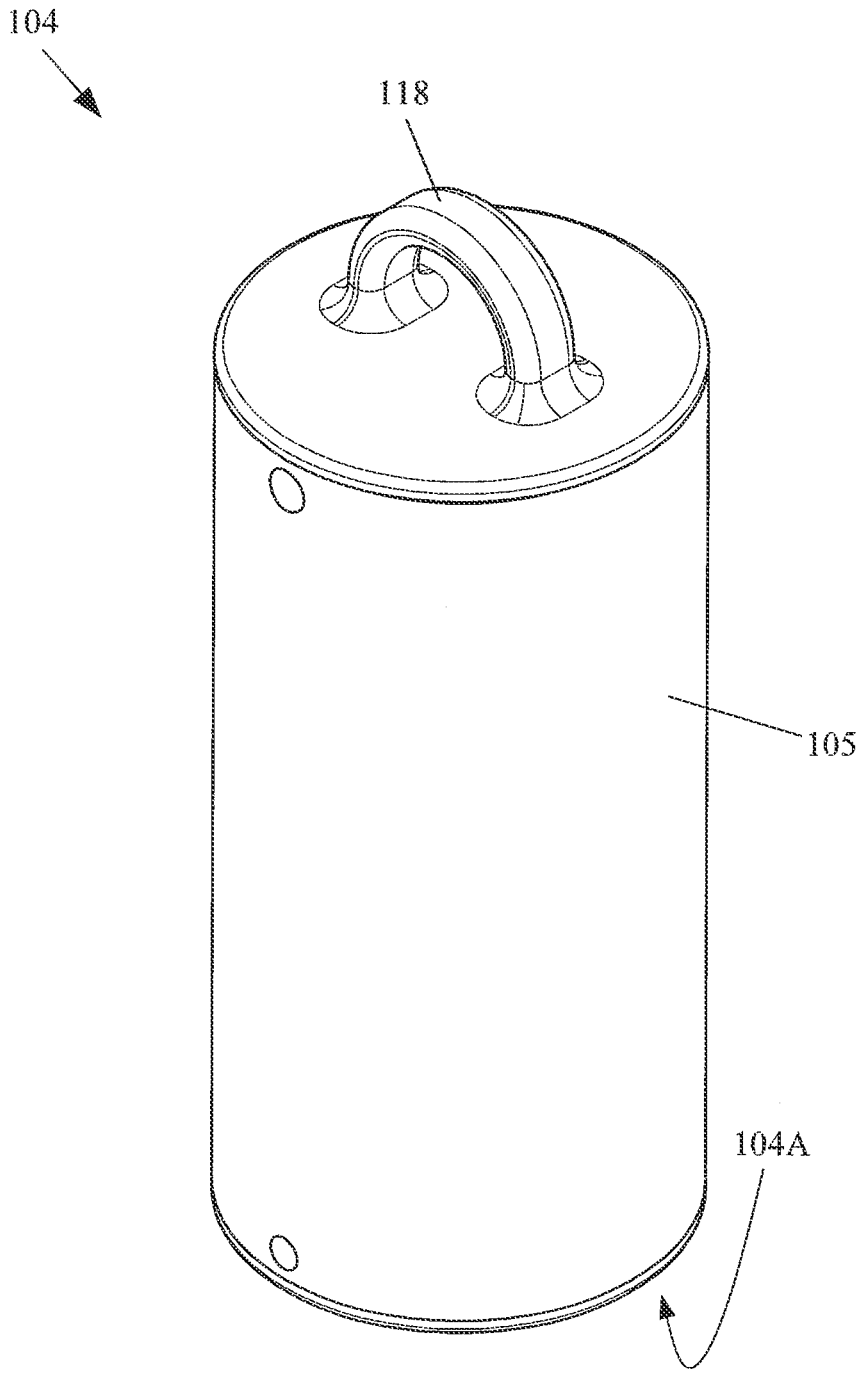
FIG. 3 is a perspective view of an example weight insert.

Some example medicine ball bodies 102 may include a cavity 112 configured to receive one or more weight inserts 104 (see, e.g., FIG. 3). For example, medicine ball body 102 may include a generally circular, generally cylindrical cavity 112 (e.g., an empty shaft), which may extend at least partway through medicine ball body 102 (e.g., it may be open at the top and/or the bottom). In some example embodiments, cavity 112 may be arranged generally in parallel with side handles 108A, 108B. In some example embodiments, cavity 112 may be slightly tapered. For example, cavity 112 may taper slightly inward (e.g., to a narrower diameter) deeper into body 102. In some example embodiments, cavity 112 may include an enlarged upper opening section, which may allow a user's hand to a grasp weight insert (see, e.g., FIG. 3) installed therein.

FIG. 3 illustrates an example weight insert 104 according to at least some embodiments of the present disclosure. Weight insert 104 may comprise a generally cylindrical shell 105, which may be sized to be slidably received within cavity 112, bottom 104A first. Some example weight inserts 104 may include a gripping feature, such as a handle 118, which may be gripped by a user to install weight insert 104 into cavity 112 and/or remove weight insert 104 from cavity 112.

Some example weight inserts 104 may be constructed from rubber, metal (e.g., iron), and/or plastic, for example. In some example embodiments, an adjustable-weight medicine ball system may comprise a plurality of weight inserts 104 of different weights. By selectively installing weight inserts 104 of different weights into cavity 112, a user may adjust the total weight available for exercise. For example, the total weight may include the weight of the empty medicine ball body 102 plus any weight insert 104 installed therein. Some example embodiments may be configured such that total weights of 2 lbs., 4 lbs., 6 lbs., 8 lbs., 10 lbs., and/or 12 lbs. may be provided by mounting one of a plurality of weight increment inserts 104 in medicine ball body 102. In some circumstances, a user may utilize medicine ball body 102 without a weight increment insert 104 installed. Accordingly, in such circumstances, the total weight may equal the weight of medicine ball body 102.

Figure 4:
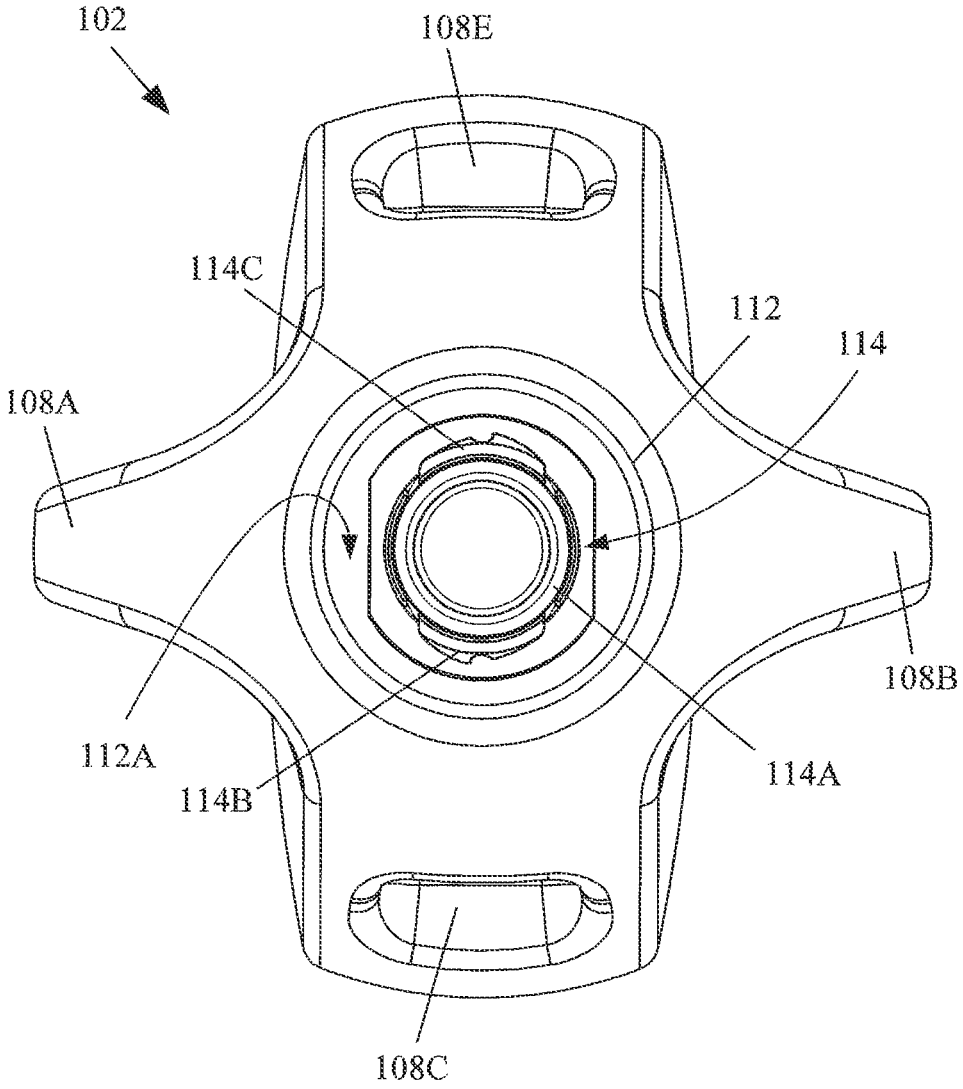
FIG. 4 is a plan view of an example medicine ball body.
Figure 6:
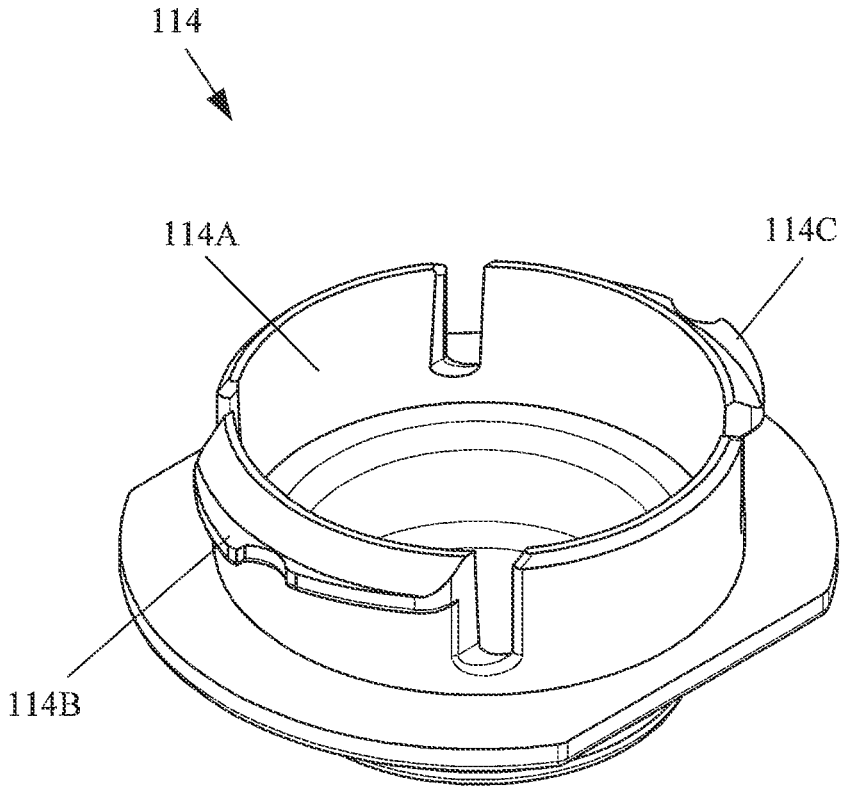
FIG. 6 is a perspective view of an example weight insert retainer.

In some example embodiments, cavity 112 and/or weight insert 104 may include one or more engagement features configured to releasably retain weight insert 104 within cavity 112. FIGS. 4-6 illustrate example engagement features that may be provided in cavity 112 for releasably engaging weight insert 104. For example, a weight insert retainer 114 may comprise a concentric upstanding ring 114A, which may extend axially upward from a bottom 112A of cavity 112. Ring 114A may include one or more generally diametrically opposed (or circumferentially arranged) radially extending tabs 114B, 114C. Also, as mentioned above, FIG. 5 illustrates example front handles 108C, 108D and example rear handles 108E, 108F.

Figure 7:
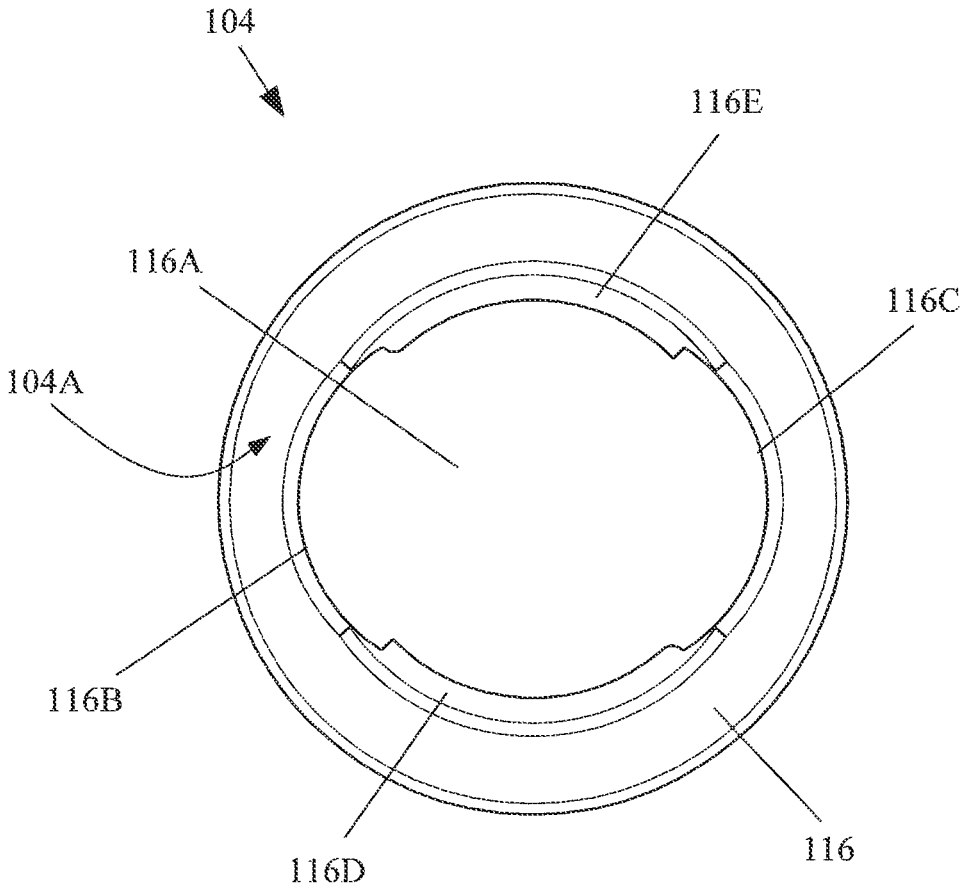
FIG. 7 is a bottom view of an example weight insert.

FIG. 7 is a bottom view of an example weight insert 104, illustrating an example corresponding engagement feature, e.g., weight insert catch 116. Catch 116 may comprise a central opening 116A on bottom 104A of weight insert 104. Central opening 116A may be configured to receive weight insert retainer 114 therethrough. When aligned with tabs 114B, 114C, diametrically opposed (or circumferentially arranged) extended portions 116B, 116C of opening 116 may allow tabs 114B, 114C to pass through. Opposed radially inwardly extending tabs 116D, 116E may extend into opening 116 generally circumferentially between opposed extended portions 116B, 116C.

Figure 8:
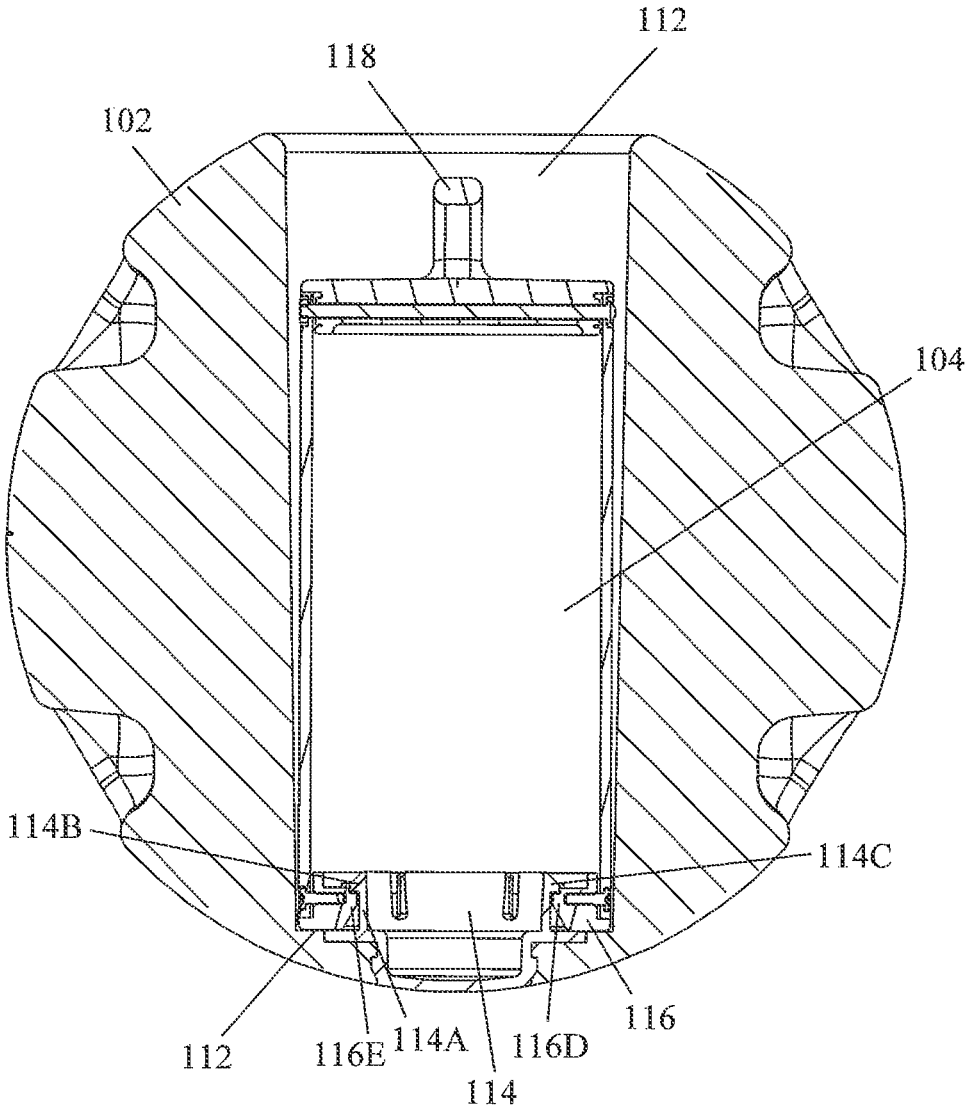
FIG. 8 is an elevation cross-section view of an example medicine ball body with an example weight insert installed therein.

Weight insert retainer 114 and weight insert catch 116 may comprise a lock configured to releasably retain weight insert 104 in cavity 112 of medicine ball body 102. When extended portions 116B, 116C of opening 116 (on the bottom of weight insert 104) are aligned with tabs 114B, 114C of weight insert retainer 114 (in the bottom 112A of cavity 112), tabs 114B, 114C may pass through opening 116. As shown in FIG. 8, weight insert 104 may be rotated about 90 degrees (or some other amount, depending upon the arrangement of the tabs) with respect to medicine ball body 102 (e.g., using handle 118), which may cause tabs 114B, 114C (associated with cavity 112) to engage tabs 116D, 116E (associated with weight insert 104). Engagement of tabs 114B, 114C with tabs 116D, 116E may prevent weight insert 104 from being withdrawn from cavity 112.

When it is desired to remove weight insert 104 from cavity 112, weight insert 104 may be rotated about 90 degrees to align extended portions 116B, 116C of opening 116 (associated with weight insert 104) with tabs 114B, 114C (associated with cavity 112). Once tabs 114B, 114C are aligned with extended portions 116B, 116C, weight insert 104 may be withdrawn from cavity 112.

As illustrated in FIG. 8, in some example embodiments, handle 118 and weight insert 104 may be configured such that handle 118 may be substantially within cavity 112 when weight insert 104 is installed in cavity 112.

Figure 9:
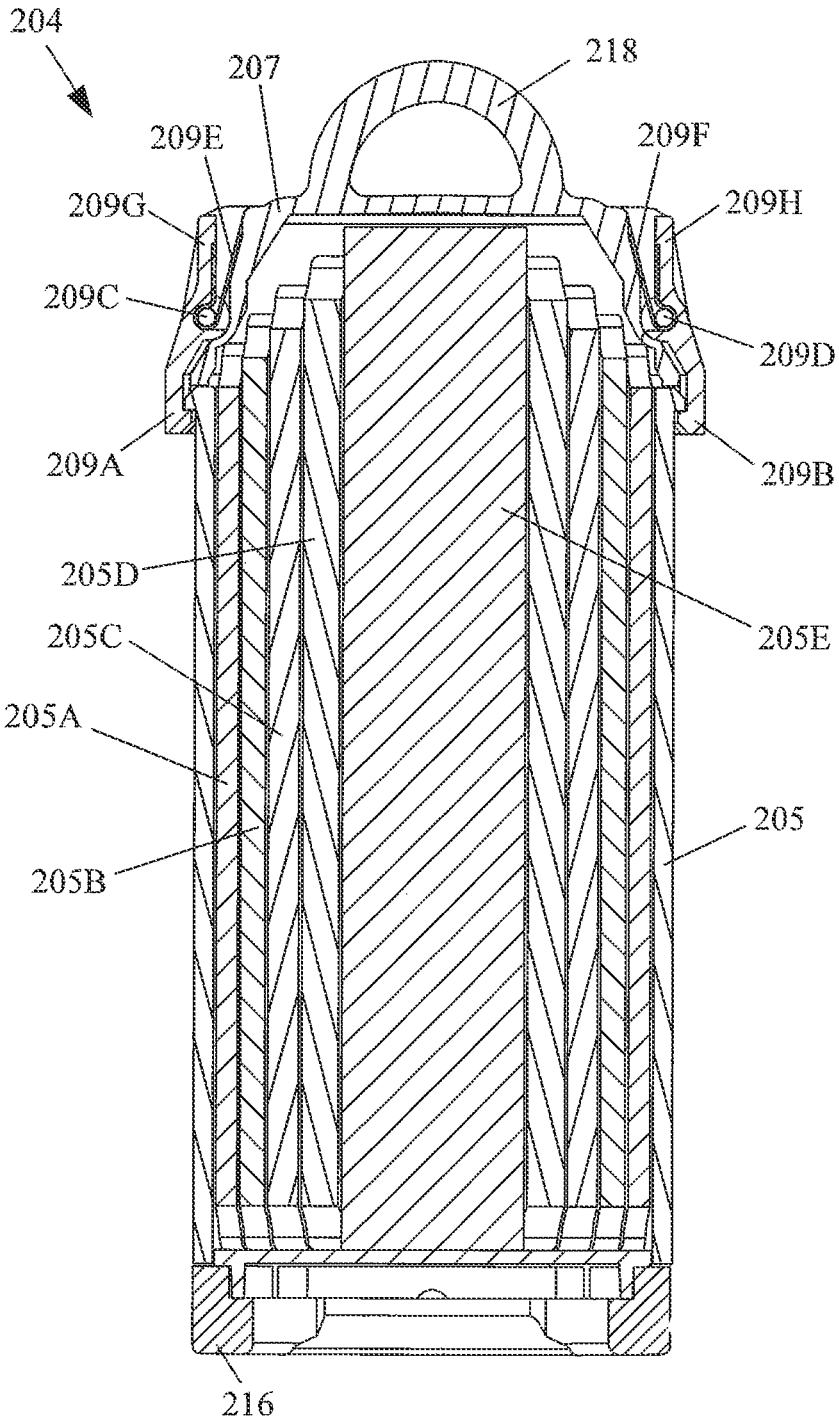
FIG. 9 is an elevation cross-section view of an example concentric weight insert.

In some example embodiments, a plurality of differently weighted weight inserts may be provided to allow a user to vary the total weight of a medicine ball. In some example embodiments, the weight of a weight insert may be adjustable to allow a user to vary the total weight of the medicine ball. For example, FIG. 9 illustrates an adjustable-weight concentric weight insert according to at least some embodiments of the present disclosure. Concentric weight insert 204 may be configured to be received in cavity 112 of medicine ball body 102 in a generally similar manner to weight increment insert 104.

In some example embodiments, concentric weight insert 204 may comprise a generally cylindrical shell 205, which may be sized to be received within cavity 112. Some example concentric weight inserts 204 may include a gripping feature, such as a handle 218, which may be gripped by a user to install concentric weight insert 204 into cavity 112 and/or to remove concentric weight insert 204 from cavity 112. Some example concentric weight inserts 204 may include a weight insert catch 216, which may be generally similar to weight increment insert catch 116 discussed above in connection with weight insert 104.

In some example embodiments, concentric weight insert 204 may include a plurality of removable concentric weights 205A, 205B, 205C, 205D, which may be arranged around a central post 205E. Individual weights 205A, 205B, 205C, 205D may comprise a generally tubular body configured to be received generally concentrically within cylindrical shell 205 and/or with respect to other individual weights 205A, 205B, 205C, 205D and/or post 205E.

In some example embodiments, a cap 207 may be releasably mounted to cylindrical shell 205, such as by latches 209A, 209B. Latches 209A, 209B may be mounted to cap 207 by respective pivots 209C, 209D, and latches 209A, 209B may be biased into latching engagement with cylindrical shell 205 by respective springs 209E, 209F. An individual latch 209A, 209B may include a handle 209G, 209H, which may be utilized by a user to pivot latches 209A, 209B into a disengaged position with respect to shell 205 to allow removal of cap 207 from shell 205. For example, cap 207 may be removed from shell 205 when it is desired to install or remove one or more of weights 205A, 205B, 205C, 205D from concentric weight insert 204.

Figure 10:
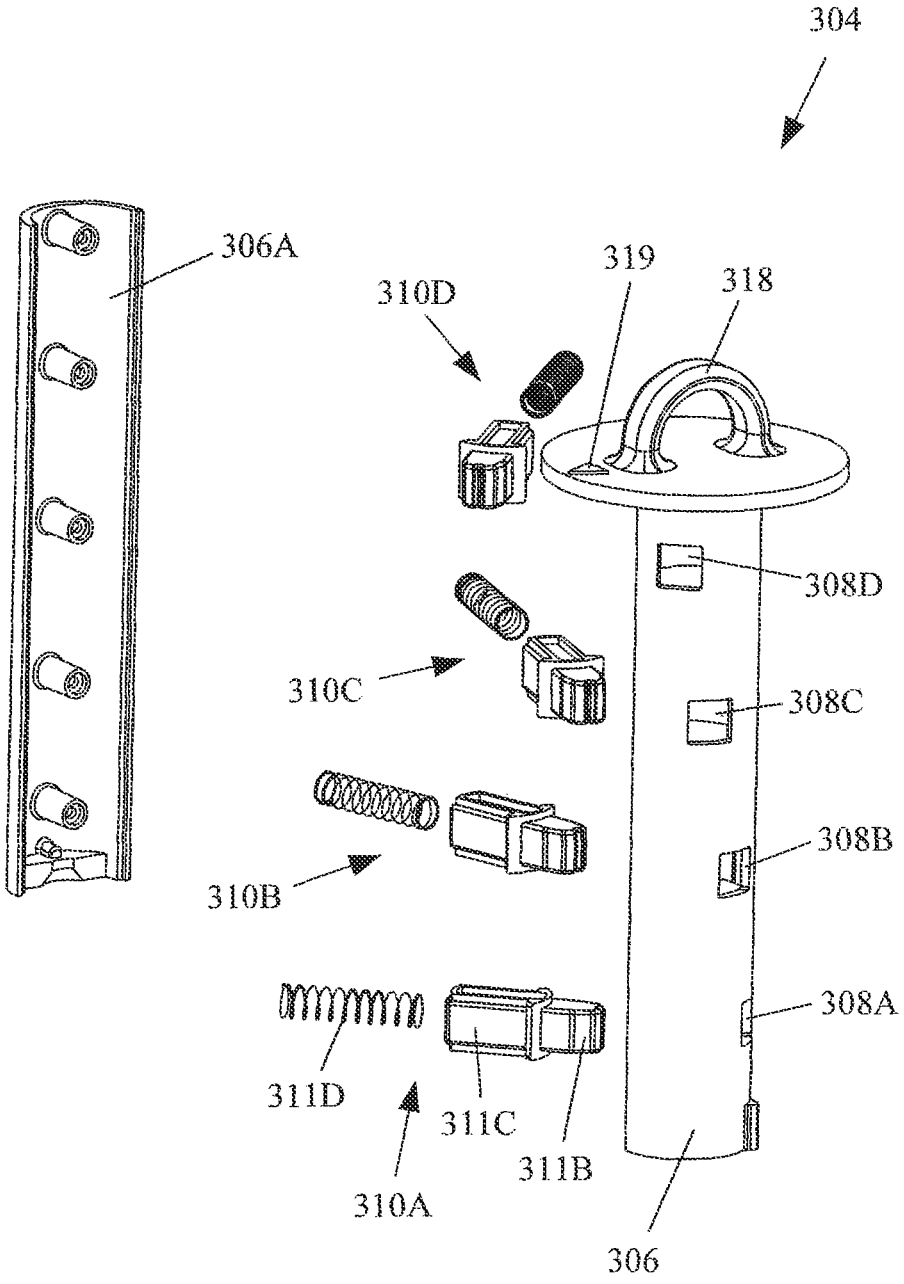
FIG. 10 is an exploded perspective view of an example weight holder for an example ring weight insert.
Figure 11:
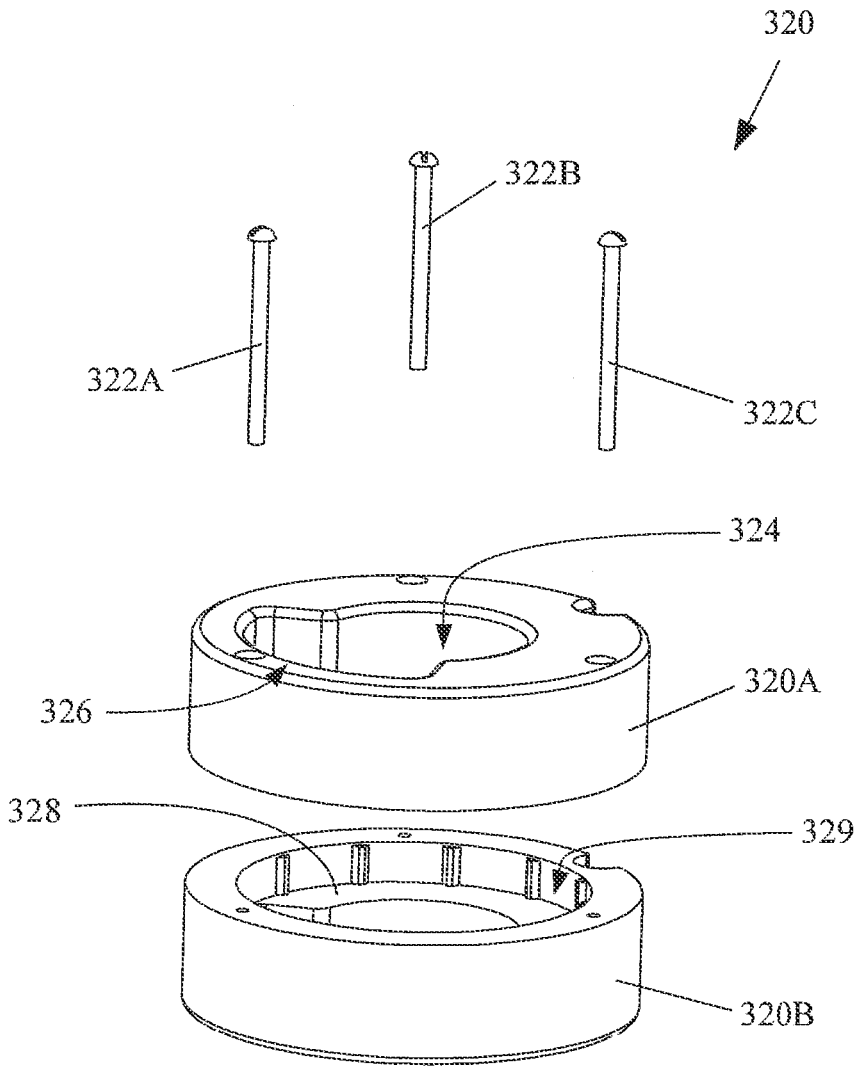
FIG. 11 is an exploded perspective view of an example ring weight.

FIGS. 10 and 11 illustrate another example adjustable-weight weight insert, a ring weight insert 304. Referring to FIG. 10, ring weight insert 304 may comprise a weight holder 306, which may join with a cover 306A to form a generally cylindrical rod. Weight holder 306 may include a plurality of radially oriented openings 308A, 308B, 308C, 308D, which may receive spring-biased tooth assemblies 310A, 310B, 310C, 310D. An individual tooth assembly, e.g., tooth assembly 310A, may include a tooth 311B, which may be slidably received in a tooth housing 311C. A spring 311D (e.g., a helical coil compression spring) may be arranged to bias tooth 311B such that it extends generally radially from opening 308A when tooth assembly 310A is installed in weight holder 306. Tooth assemblies 310B, 310C, 310D may be configured similarly. Weight holder 306 may include a handle 318 and/or an indicia 319, which may aid a user in perceiving the angular position of weight holder 306.

An example ring weight insert 304 may comprise weight holder 306 and a plurality (e.g., four) ring weights 320 as illustrated in FIG. 11. An example ring weight 320 may comprise an upper section 320A and/or a lower section 320B. Upper section 320A and lower section 320B may be substantially mirror images of each other. Accordingly, the following discussion of their features references the portions visible in FIG. 11 but generally applies to the opposing section as well.

In some example embodiments, when assembled (e.g., using fasteners 322A, 322B, 322C), upper section 320A and lower section 320B may provide a central through passage 324, which may be configured to receive weight holder 306. Upper section 320A and/or lower section 320B may include an enlarged cutout section 326 contiguous with central through passage 324. Cutout section 326 may allow tooth 311B (and the teeth of other tooth assemblies) to pass axially therethrough.

In some example embodiments, upper section 320A and/or lower section 320B may include an internal cutout shelf 328, which may provide a generally ring-shaped internal void 329 around central through passage 324. Ring-shaped internal void 329 may be bounded on its upper side by upper section 320A and on its lower side by lower section 320B, except where it may be open to above and below through enlarged cutout section 326. Because enlarged cutout section 326 may allow tooth 311B (and the teeth of other tooth assemblies) to pass axially therethrough and because ring-shaped internal void 329 may be contiguous, tooth 311B may be inserted axially into ring weight 320 through enlarged cutout section 326 and then weight holder 306 may be rotated to place tooth 311B in ring-shaped internal void 329. Because ring-shaped internal void 329 may be bounded on its upper and lower sides by upper section 320A and lower section 320B, respectively, tooth 311B may be constrained, in the axial direction, in ring weight 320. Accordingly, ring weight 320 may be lifted using weight holder 306 as long as tooth 311B is within the ring-shaped internal void 329 and is not aligned with enlarged cutout section 326.

Referring back to FIG. 10, openings 308A, 308B, 308C, 308D on weight holder 306 may be angularly separated with respect to each other. Accordingly, tooth assemblies 310A, 310B, 310C, 310D may be angularly separated with respect to each other. Thus, if weight holder 306 is inserted into a stack of four ring weights 320 (with their enlarged cutout sections 326 aligned) and rotated clockwise, tooth assembly 308D may engage the top ring weight's ring-shaped internal void 329. Then, tooth assembly 310 C may engage the second from the top ring weight's ring-shaped internal void 329. Next, tooth assembly 310B may engage the second from the bottom ring weight's ring-shaped internal void 329. Finally, tooth assembly 310A may engage the bottom ring weight's ring-shaped internal void 329. Thus, by rotating weight holder 306 with respect to a stack of ring weights 320, a user may engage 0-4 ring weights 320. For example, a user may rotate weight holder 306 to engage only two ring weights 320. Then, the user may install ring weight insert 304 (comprising weight holder 306 and two ring weights 320) into cavity 112 of medicine ball body 102 in a manner generally similar to that described above with respect to weight insert 102.

Figure 12:
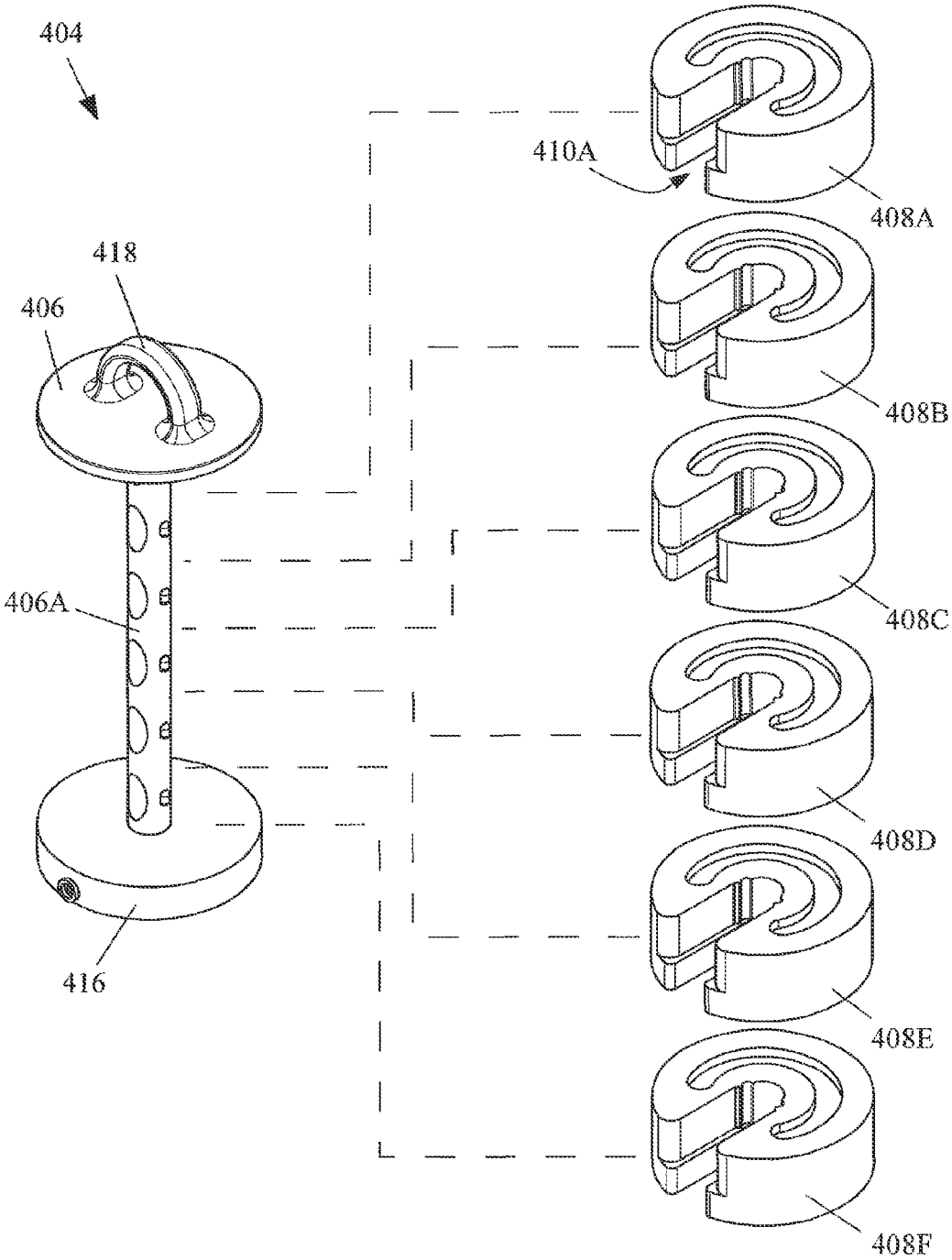
FIG. 12 is an exploded perspective view of an example slotted weight insert.

FIG. 12 illustrates an example slotted weight insert 404, which may provide another alternative adjustable-weight weight insert. Slotted weight insert 404 may comprise a weight holder 406. Weight holder 406 may include a support rod 406A configured to receive a plurality of slotted weights 408A, 408B, 408C, 408D, 408E, 408F. Weight holder 406 may include a handle 418 and/or a weight insert catch 416, which may be generally similar to weight insert catch 116 described above.

Individual slotted weights 408A, 408B, 408C, 408D, 408E, 408F may be generally disc-shaped and/or may include a slot 410A, which may receive support rod 406A.

A user may stack a desired number of slotted weights 408A, 408B, 408C, 408D, 408E, 408F on weight holder 406. Then, the user may install weight insert 404 into cavity 112 of medicine ball 102 as described above.

Figure 13:
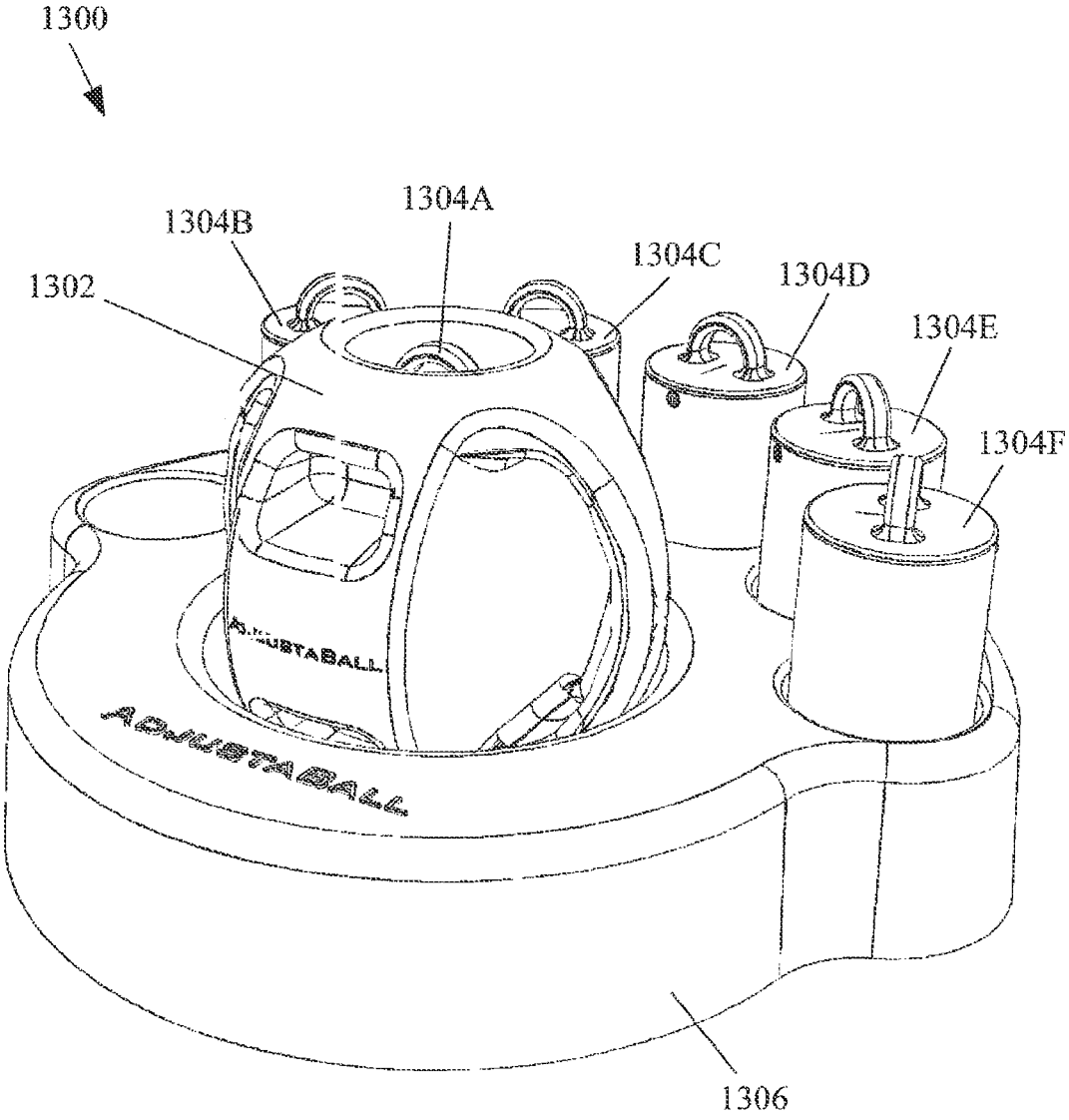
FIG. 13 is a perspective view of an example adjustable-weight medicine ball system; all arranged in accordance with at least some embodiments of the present disclosure.

FIG. 13 illustrates an example adjustable-weight medicine ball system 1300 according to at least some embodiments of the present disclosure. System 1300 may include a medicine ball body 1302 and one or more weight inserts 1304A (shown installed in medicine ball body 1302), 1304B, 1304C, 1304D, 1304E, 1304F. A rack 1306 may be configured to receive medicine ball body 1302 and/or weight inserts 1304A, 1304B, 1304C, 1304D, 1304E, 1304F.

Some example medicine ball bodies 1302 according to the present disclosure may be manufactured using a molding process. Engagement features (e.g., weight insert retainer 114) may be integrally molded into medicine ball body 1302 and/or may be inserted as separate pieces after molding. Weight inserts 1304A, 1304B, 1304C, 1304D, 1304E, 1304F may have substantially the same exterior size and/or shape. By varying the thickness of the walls, contents of the interiors, etc., of individual weight inserts 1304A, 1304B, 1304C, 1304D, 1304E, 1304F, various weights may be provided while maintaining about the same exterior configuration.

Some example embodiments may include weight inserts which may have shapes different than a right circular cylinder. For example, some alternative weight increments may be generally rectangular.

Although some example embodiments may have a generally spherical form, the present disclosure contemplates that the shape, size, and/or weight of medicine ball body 1302 may be varied. Any shape (such as generally square, generally rectangular, or generally oval) may be used instead of generally circular. In some alternative example embodiments, cavity 112 may have an alternative shape, such as generally square or generally rectangular. Also, some example medicine balls may be provided with or without handles. Similarly, various total weights may be provided by based on the weight of medicine ball body 1302 and the weights of weight inserts 1304A, 1304B, 1304C, 1304D, 1304E, 1304F.

It is within the scope of the present disclosure to utilize alternative engagement features to retain weight inserts within exercise device bodies. For example, embodiments employing different numbers of tabs (e.g., one, three, four, etc.) on an individual engagement feature are within the scope of the disclosure. Also, other alternative engagement features are within the scope of the disclosure. For example, some embodiments according to the present disclosure may utilize a threaded interface between a weight insert and a medicine ball body. Some embodiments may utilize tabs configured to engage slots. Some example embodiments may include one or more spring-biased tabs configured to engage a slot or depression, such as an annular slot provided on a generally cylindrical projection. Some example embodiments may utilize a friction fit between components.

It is within the scope of the present disclosure to configure other pieces of fitness equipment as described herein. For example and without limitation, in addition to medicine balls, kettle bells, dumbbells, and similar devices are within the scope of the disclosure.

While example embodiments have been set forth above for the purpose of disclosure, modifications of the disclosed embodiments as well as other embodiments thereof may occur to those skilled in the art. Accordingly, it is to be understood that the disclosure is not limited to the above precise embodiments and that changes may be made without departing from the scope. Likewise, it is to be understood that it is not necessary to meet any or all of the stated advantages or objects disclosed herein to fall within the scope of the disclosure, since inherent and/or unforeseen advantages of the may exist even though they may not have been explicitly discussed herein.

What is claimed is:

1. An adjustable-weight exercise device comprising:

an exercise device body generally spherical in form having at least two side handles configured to be gripped by a user, the handles shaped such that the handles do not generally extend outside of the generally spherical form; a cavity extending into the exercise device body and having at least one engagement feature therein; and a weight insert configured to be slidably received in the cavity, the weight insert having a corresponding engagement feature thereon; wherein the exercise device body engagement feature and the corresponding weight insert engagement feature are configured to releasably engage each other to retain the weight insert within the cavity.

2. The adjustable-weight exercise device of claim 1, wherein the weight insert is one of a plurality of interchangeable weight inserts, individual weight inserts having weights different than at least one other of the plurality of interchangeable weight inserts.

3. The adjustable-weight exercise device of claim 1, wherein the cavity is generally cylindrical and wherein the weight insert is generally cylindrical.

4. The adjustable-weight exercise device of claim 1, wherein the weight insert comprises a plurality of weights that may be selectively installed in and removed from the weight insert.

5. The adjustable-weight exercise device of claim 4, wherein the plurality of weights comprises a plurality of concentrically engageable, generally tubular weights.

6. The adjustable-weight exercise device of claim 4, wherein the plurality of weights comprises a plurality of ring weights configured to be selectively engaged by a rotatable weight holder.

7. The adjustable-weight exercise device of claim 4, wherein the plurality of weights comprises a plurality of disc weights comprising slots configured to engage a weight holder.

8. The adjustable-weight exercise device of claim 1, wherein the exercise device body engagement feature comprises a weight insert retainer comprising an upstanding ring extending into the cavity, the upstanding ring comprising at least one circumferentially arranged, radially extending tab.

9. The adjustable-weight exercise device of claim 8, wherein the corresponding weight insert engagement feature comprises a weight insert catch comprising a central opening configured to receive the weight insert retainer therethrough, the central opening comprising circumferentially arranged extended opening portions and circumferentially arranged, radially inwardly extending tabs circumferentially between the extended opening portions.

10. The adjustable-weight exercise device of claim 1, wherein the exercise device body is constructed from at least one of rubber and plastic.

11. An adjustable-weight medicine ball system comprising:

a medicine ball body having a generally spherical form and comprising laterally opposed side handles to be gripped by a user, the handles shaped such that the handles do not generally extend outside of the generally spherical form; and a generally cylindrical cavity, the generally cylindrical cavity comprising an engagement feature at a bottom thereof; and a first generally cylindrical weight insert configured to be received within the generally cylindrical cavity of the medicine ball body, the first weight insert comprising a corresponding engagement feature on a bottom thereof.

12. The adjustable-weight medicine ball system of claim 11, wherein one of the engagement features on the medicine ball body and the weight insert includes a first set of radially extending tabs and circumferentially arranged openings; the other of the engagement features on the medicine ball body and the weight insert includes a second set of radially extending tabs and circumferentially arranged openings; the tabs of the engagement features are axially aligned with each other when locked; and the tabs of the engagement features are axially aligned with corresponding openings when unlocked.

13. The adjustable-weight medicine ball system of claim 12 wherein the first generally cylindrical weight insert comprises a plurality of weights which may be selectively installed on and removed therefrom.

14. The adjustable-weight medicine ball system of claim 13 wherein the plurality of weights comprises a plurality of concentrically engageable, generally tubular weights.

15. The adjustable-weight medicine ball system of claim 13 wherein the plurality of weights comprises a plurality of ring weights configured to be selectively engaged by a rotatable weight holder.

16. The adjustable-weight medicine ball system of claim 11, further comprising a rack configured to receive the medicine ball body and the first generally cylindrical weight insert.

17. A method of operating an adjustable-weight medicine ball, the method comprising: sliding a first weight insert into a cavity of a medicine ball body generally spherical in form having at least two side handles configured to be gripped by a user, the handles shaped such that the handles do not generally extend outside of the generally spherical form, to engage an upstanding ring proximate a bottom of the cavity with an opening proximate a bottom of the first weight insert; rotating the first weight insert with respect to the cavity to engage at least two radially outwardly extending, circumferentially arranged tabs on the upstanding ring with at least two radially inwardly extending tabs on the opening.

18. The method of claim 17, further comprising rotating the first weight insert to disengage the at least two radially outwardly extending, circumferentially arranged tabs on the upstanding ring from the at least two radially inwardly extending tabs on the opening; sliding the first weight insert out of the cavity; sliding a second weight insert into the cavity to engage the upstanding ring proximate the bottom of the cavity with an opening proximate a bottom of the second weight insert; rotating the second weight insert with respect to the cavity to engage the at least two radially outwardly extending, circumferentially arranged tabs on the upstanding ring with at least two radially inwardly extending tabs on the opening proximate the bottom of the second weight insert.

19. The method of claim 18 further comprising rotating the first weight insert to disengage the at least two radially outwardly extending, circumferentially arranged tabs on the upstanding ring from the at least two radially inwardly extending tabs on the opening; sliding the first weight insert out of the cavity; at least one of installing and removing at least one of a plurality of weights associated with the first weight insert; sliding the first weight insert into the cavity to engage the upstanding ring proximate the bottom of the cavity with the opening proximate the bottom of the first weight insert; rotating the second weight insert with respect to the cavity to engage the at least two radially outwardly extending, circumferentially arranged tabs on the upstanding ring with the at least two radially inwardly extending tabs on the opening proximate the bottom of the first weight insert.

* * * * *